US009803491B2

(12) United States Patent
Clouse et al.

(10) Patent No.: US 9,803,491 B2
(45) Date of Patent: Oct. 31, 2017

(54) BLADE OUTER AIR SEAL HAVING SHIPLAP STRUCTURE

(71) Applicant: United Technologies Corporation, Hartford, CT (US)

(72) Inventors: Brian Ellis Clouse, Saugus, MA (US); David F. Cloud, Simsbury, CT (US); Donna Clough, Tolland, CT (US)

(73) Assignee: United Technologies Corporation, Farmington, CT (US)

( * ) Notice: Subject to any disclaimer, the term of this patent is extended or adjusted under 35 U.S.C. 154(b) by 859 days.

(21) Appl. No.: 13/731,154

(22) Filed: Dec. 31, 2012

(65) Prior Publication Data

US 2014/0186163 A1 Jul. 3, 2014

(51) Int. Cl.

| | |
|---|---|
| ***F01D 11/02*** | (2006.01) |
| ***F01D 11/00*** | (2006.01) |
| ***F01D 25/24*** | (2006.01) |

(52) U.S. Cl.

CPC ..... *F01D 11/005* (2013.01); *F01D 25/246* (2013.01); *F05D 2240/11* (2013.01); *Y10T 29/49297* (2015.01)

(58) Field of Classification Search

CPC ..... F01D 11/005; F01D 11/08; F01D 11/12; F01D 11/127; F01D 11/24; F01D 25/246

See application file for complete search history.

(56) References Cited

U.S. PATENT DOCUMENTS

| | | | | |
|---|---|---|---|---|
| 4,337,016 A * | 6/1982 | Chaplin | F01D 11/24 | 415/116 |
| 4,512,712 A | 4/1985 | Baran, Jr. | | |
| 4,573,866 A | 3/1986 | Sandy, Jr. et al. | | |
| 4,642,024 A | 2/1987 | Weidner | | |
| 4,650,394 A * | 3/1987 | Weidner | F01D 11/08 | 415/115 |
| 4,856,963 A * | 8/1989 | Klapproth | F01D 9/042 | 415/189 |
| 4,925,365 A * | 5/1990 | Crozet | F01D 9/04 | 277/415 |
| 5,044,881 A | 9/1991 | Dodd et al. | | |
| 5,145,316 A * | 9/1992 | Birch | F01D 5/225 | 415/173.1 |

(Continued)

FOREIGN PATENT DOCUMENTS

| | | | |
|---|---|---|---|
| DE | EP 1106785 A1 * | 6/2001 | F01D 11/08 |
| EP | 1106785 A1 | 6/2001 | |

OTHER PUBLICATIONS

International Search Report and Written Opinion for PCT Application No. PCT/US2013/077066 dated Apr. 7, 2014.

(Continued)

*Primary Examiner* — Dwayne J White
*Assistant Examiner* — Justin Seabe
(74) *Attorney, Agent, or Firm* — Carlson, Gaskey & Olds

(57) ABSTRACT

A blade outer air seal (BOAS) for a gas turbine engine, according to an exemplary aspect of the present disclosure includes, among other things a seal body having a radially inner face and a radially outer face that axially extend between a leading edge portion and a trailing edge portion and a shiplap structure that at least partially overlaps at least a portion of at least one of the leading edge portion and the trailing edge portion.

18 Claims, 3 Drawing Sheets

(56) References Cited

U.S. PATENT DOCUMENTS

| | | | | |
|---|---|---|---|---|
| 5,192,185 | A * | 3/1993 | Leonard | F01D 11/08 415/170.1 |
| 5,791,871 | A | 8/1998 | Sech et al. | |
| 6,179,557 | B1 * | 1/2001 | Dodd | F01D 9/00 415/108 |
| 6,652,226 | B2 * | 11/2003 | Albrecht, Jr. | F01D 5/225 415/173.4 |
| 6,962,482 | B2 * | 11/2005 | Tanaka | F01D 5/225 277/414 |
| 7,144,220 | B2 | 12/2006 | Marcin, Jr. | |
| 7,407,368 | B2 * | 8/2008 | Tanaka | F01D 9/04 415/173.1 |
| 7,553,128 | B2 | 6/2009 | Abdel-Messeh et al. | |
| 7,686,068 | B2 | 3/2010 | Tholen et al. | |
| 7,721,433 | B2 | 5/2010 | Thompson et al. | |
| 7,988,410 | B1 | 8/2011 | Liang | |
| 8,052,385 | B2 | 11/2011 | Thompson et al. | |
| 8,061,979 | B1 | 11/2011 | Liang | |
| 8,118,547 | B1 | 2/2012 | Liang | |
| 8,122,583 | B2 | 2/2012 | Luczak et al. | |
| 2004/0213666 | A1 | 10/2004 | Gieg et al. | |
| 2006/0056961 | A1 * | 3/2006 | Czachor | F01D 5/143 415/173.4 |
| 2008/0211192 | A1 | 9/2008 | Pietraszkiewicz et al. | |
| 2008/0240915 | A1 * | 10/2008 | Castel | F01D 9/04 415/208.2 |
| 2009/0087306 | A1 | 4/2009 | Tholen et al. | |
| 2009/0169368 | A1 | 7/2009 | Schlichting et al. | |
| 2009/0214329 | A1 | 8/2009 | Joe et al. | |
| 2011/0171011 | A1 | 7/2011 | Lutjen et al. | |
| 2012/0319362 | A1 | 12/2012 | Tholen et al. | |

OTHER PUBLICATIONS

International Preliminary Report on Patentability for PCT Application No. PCT/US2013/077066, dated Jul. 9, 2015.

Supplementary European Search Report for Application No. EP 13 86 8070 dated Jul. 1, 2016.

* cited by examiner

BLADE OUTER AIR SEAL HAVING SHIPLAP STRUCTURE

BACKGROUND

This disclosure relates to a gas turbine engine, and more particularly to a blade outer air seal (BOAS) that may be incorporated into a gas turbine engine.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections may include alternating series of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes, which generally do not rotate, guide the airflow and prepare it for the next set of blades.

A casing of an engine static structure may include one or more blade outer air seals (BOAS) that provide an outer radial flow path boundary of the core flow path. The BOAS are positioned in relative close proximity to a blade tip of each rotating blade in order to seal between the blades and the casing.

SUMMARY

A blade outer air seal (BOAS) for a gas turbine engine, according to an exemplary aspect of the present disclosure includes, among other things a seal body having a radially inner face and a radially outer face that axially extend between a leading edge portion and a trailing edge portion and a shiplap structure that at least partially overlaps at least a portion of at least one of the leading edge portion and the trailing edge portion.

In a further non-limiting embodiment of the foregoing blade outer air seal, a retention flange extends from the seal body at the leading edge portion.

In a further non-limiting embodiment of either of the foregoing blade outer air seals, the retention flange includes a radially outer portion and a radially inner portion, and the radially outer portion is received within a slot of a casing of the gas turbine engine and a vane segment rests against the radially inner portion.

In a further non-limiting embodiment of any of the foregoing blade outer air seals, a seal land extends from the seal body radially inwardly from the retention flange.

In a further non-limiting embodiment of any of the foregoing blade outer air seals, the shiplap structure includes a first shiplap portion that overlaps the leading edge portion of the seal body.

In a further non-limiting embodiment of any of the foregoing blade outer air seals, the shiplap structure includes a second shiplap portion that overlaps the trailing edge portion of the seal body.

In a further non-limiting embodiment of any of the foregoing blade outer air seals, the first shiplap portion radially extends from a body portion of the shiplap structure that is attached to the radially outer face of the seal body.

In a further non-limiting embodiment of any of the foregoing blade outer air seals, a seal is attached to a radially outer portion of the first shiplap portion.

In a further non-limiting embodiment of any of the foregoing blade outer air seals, the shiplap structure overlaps the leading edge portion, the trailing edge portion and the radially outer face of the seal body.

In a further non-limiting embodiment of any of the foregoing blade outer air seals, the shiplap structure overlaps a radially outer portion of a retention flange that extends from the leading edge portion of the seal body.

In a further non-limiting embodiment of any of the foregoing blade outer air seals, a portion of the shiplap structure is circumferentially offset from a mate face of the seal body.

A gas turbine engine according to an exemplary aspect of the present disclosure includes, among other things, a compressor section, a combustor section in fluid communication with the compressor section and a turbine section in fluid communication with the combustor section, and a blade outer air seal (BOAS) associated with at least one of the compressor section and the turbine section. The BOAS includes a seal body having a radially inner face and a radially outer face that axially extend between a leading edge portion and a trailing edge portion. A retention flange extends from one of the leading edge portion and the trailing edge portion and a shiplap structure at least partially overlaps at least a portion of the retention flange.

In a further non-limiting embodiment of the foregoing gas turbine engine, the retention flange includes a radially outer portion and a radially inner portion, and the radially outer portion is received within a slot of the casing and a vane segment of one of the compressor section and the turbine section rests against the radially inner portion.

In a further non-limiting embodiment of either of the foregoing gas turbine engines, the trailing edge portion includes an engagement feature that retains the BOAS relative to a casing of the gas turbine engine.

In a further non-limiting embodiment of any of the foregoing gas turbine engines, the shiplap structure overlaps at least a portion of the engagement feature.

In a further non-limiting embodiment of any of the foregoing gas turbine engines, the shiplap structure overlaps the leading edge portion, the trailing edge portion and the radially outer face of the seal body.

A method of sealing portions of a blade outer air seal (BOAS) of a gas turbine engine according to another exemplary aspect of the present disclosure includes, among other things, overlapping at least a portion of at least one of a leading edge portion and a trailing edge portion of a seal body of the BOAS with a shiplap structure.

In a further non-limiting embodiment of the foregoing method of sealing portions of a BOAS of a gas turbine engine, the method includes overlapping a retention flange of the leading edge portion with the shiplap structure.

In a further non-limiting embodiment of either of the foregoing methods of sealing portions of a BOAS of a gas turbine engine, the method includes overlapping an engagement feature of the trailing edge portion with the shiplap structure.

In a further non-limiting embodiment of either of the foregoing methods of sealing portions of a BOAS of a gas turbine engine, the method includes overlapping a radially outer face of the seal body with the shiplap structure.

The various features and advantages of this disclosure will become apparent to those skilled in the art from the following detailed description. The drawings that accompany the detailed description can be briefly described as follows.

DETAILED DESCRIPTION

Figure 1:
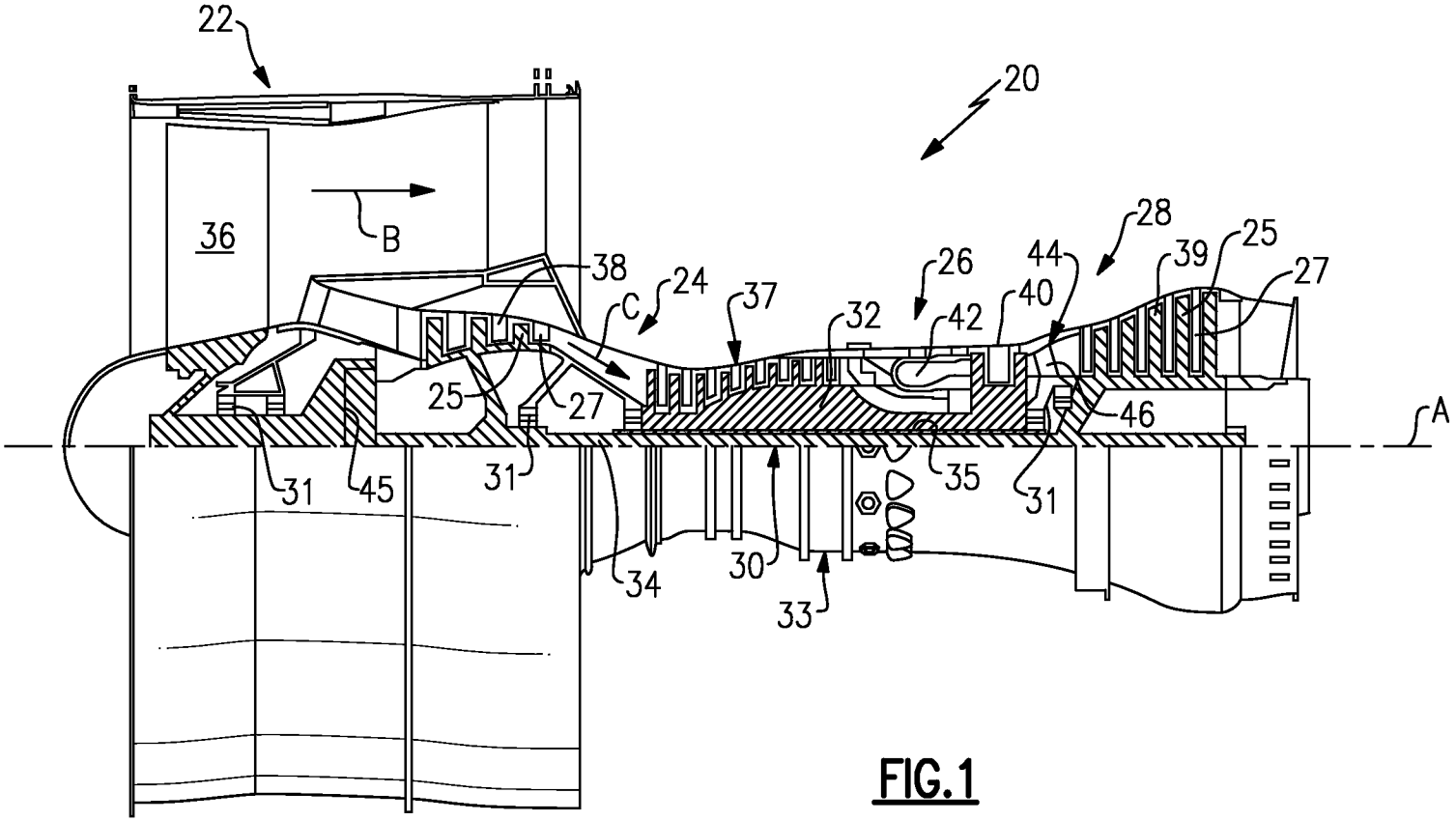
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, turboshaft engines.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that additional bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 supports one or more bearing systems 31 of the turbine section 28. The mid-turbine frame 44 may include one or more airfoils 46 that may be positioned within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

In one non-limiting example, the gas turbine engine 20 is a high-bypass geared aircraft engine. In a further example, the gas turbine engine 20 bypass ratio is greater than about six (6:1). The geared architecture 45 can include an epicyclic gear train, such as a planetary gear system or other gear system. The example epicyclic gear train has a gear reduction ratio of greater than about 2.3, and in another example is greater than about 2.5:1. The geared turbofan enables operation of the low speed spool 30 at higher speeds which can increase the operational efficiency of the low pressure compressor 38 and low pressure turbine 39 and render increased pressure in a fewer number of stages.

A pressure ratio associated with the low pressure turbine 39 is pressure measured prior to the inlet of the low pressure turbine 39 as related to the pressure at the outlet of the low pressure turbine 39 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about 5 (5:1). It should be understood, however, that the above parameters are only exemplary of one embodiment of a geared architecture engine and that the present disclosure is applicable to other gas turbine engines including direct drive turbofans.

In one embodiment, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of "T"/$518.7^{0.5}$. T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from core airflow that is communicated through the gas turbine engine 20. The vanes 27 of the vane assemblies direct core airflow to the blades 25 of the rotor assemblies to either add or extract energy. As is discussed in greater detail below, blade outer air seals (BOAS) can be positioned in relative close proximity to the blade tip of each blade 25 in order to seal between the blades 25 and the engine static structure 33.

Figure 2:
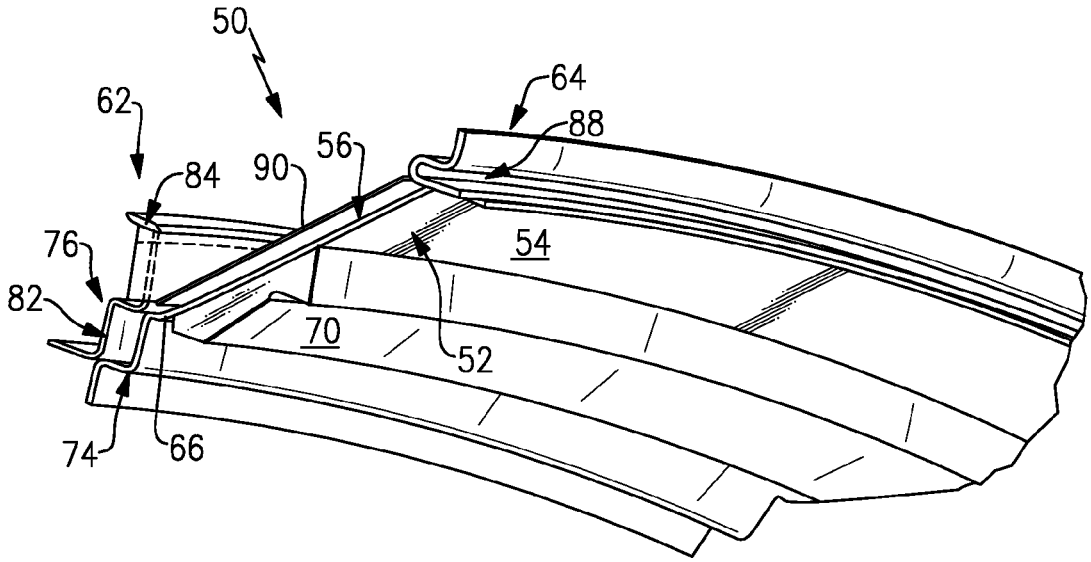
FIG. 2 illustrates a blade outer air seal (BOAS) that can be incorporated into a gas turbine engine.

FIG. 2 illustrates one exemplary embodiment of a BOAS 50 that may be incorporated into a gas turbine engine, such as the gas turbine engine 20. The BOAS 50 of this exemplary embodiment is a segmented BOAS that can be positioned and assembled relative to a multitude of additional BOAS segments to form a full ring hoop assembly that circumscribe the rotating blades 25 of either the compressor section 24 or the turbine section 28 of the gas turbine engine 20. The BOAS 50 can be circumferentially disposed about the engine centerline axis A (See FIG. 4). It should be understood that the BOAS 50 could embody other designs and configurations within the scope of this disclosure.

The BOAS 50 includes a seal body 52 having a radially inner face 54 and a radially outer face 56. The seal body 52 axially extends between a leading edge portion 62 and a trailing edge portion 64, and circumferentially extends between a first mate face 66 and a second mate face (not shown) opposite from the first mate face 66. The BOAS 50 may be constructed from any suitable sheet metal. Other materials, including but not limited to high temperature metallic alloys, are also contemplated as within the scope of this disclosure.

A seal 70 can be secured to the radially inner face 54 of the seal body 52. The seal 70 may be brazed or welded to the radially inner face 54, or could be attached using other techniques. In one exemplary embodiment, the seal 70 is a honeycomb seal that interacts with a blade tip 58 of a blade 25 (see FIG. 4) to reduce airflow leakage around the blade tip 58. A thermal barrier coating can also be applied to at least a portion of the radially inner face 54 and/or the seal 70 to protect the underlying substrate of the BOAS 50 from thermal fatigue and to enable higher operating temperatures. Any suitable thermal barrier coating could be applied to any portion of the BOAS 50.

In one exemplary embodiment, the leading edge portion 62 of the BOAS 50 includes a seal land 74 and a retention flange 76. The seal land 74 and the retention flange 76 can extend from the seal body 52. In this embodiment, the seal land 74 is formed integrally with the seal body 52 as a monolithic piece and the retention flange 76 can be attached to the seal body 52, such as by brazing or welding. Alternatively, the retention flange 76 could also be formed integrally with the seal body 52 as a monolithic piece. As discussed in greater detail below with respect to FIG. 4, the seal land 74 seals (relative to a vane 27) the gas turbine engine 20 and also radially supports the retention flange 76. The retention flange 76 secures the BOAS 50 relative to the engine static structure 33 to retain the vane 27 in the radial direction.

The trailing edge portion 64 of the BOAS 50 may also include an engagement feature 88 for attaching the trailing edge portion 64 of the BOAS 50 to the engine static structure 33. The engagement feature 88 could include a hook, a flange or any other suitable structure for supporting the BOAS 50 relative to the engine static structure 33.

The retention flange 76 may include a radially inner portion 82 and a radially outer portion 84. The radially outer portion 84 is engaged relative to the engine static structure 33 and the radially inner portion 82 is engaged relative to a vane 27 (See FIG. 4). In this exemplary embodiment, the radially inner portion 82 is generally L-shaped and the radially outer portion 84 is generally C-shaped.

The BOAS 50 may also include a shiplap structure 90 that can overlap one or more portions of the seal body 52. The shiplap structure 90 is a separate structure from the seal body 52 that can be made integral to the seal body 52, such as by welding or brazing. The shiplap structure 90 can overlap an adjacent BOAS segment to restrict airflow leakage between the BOAS 50 and an adjacent BOAS segment. In other words, the shiplap structure 90 may be circumferentially offset from the mate face 66 in a direction toward an adjacent BOAS segment by an amount greater than a gap that extends between the adjacent BOAS segments to limit airflow leakage therebetween. In this embodiment, the shiplap structure 90 circumferentially extends across the radially outer face 56 of the seal body 52 such that the shiplap structure 90 overlaps at least a portion of the radially outer face 56.

Figure 3:
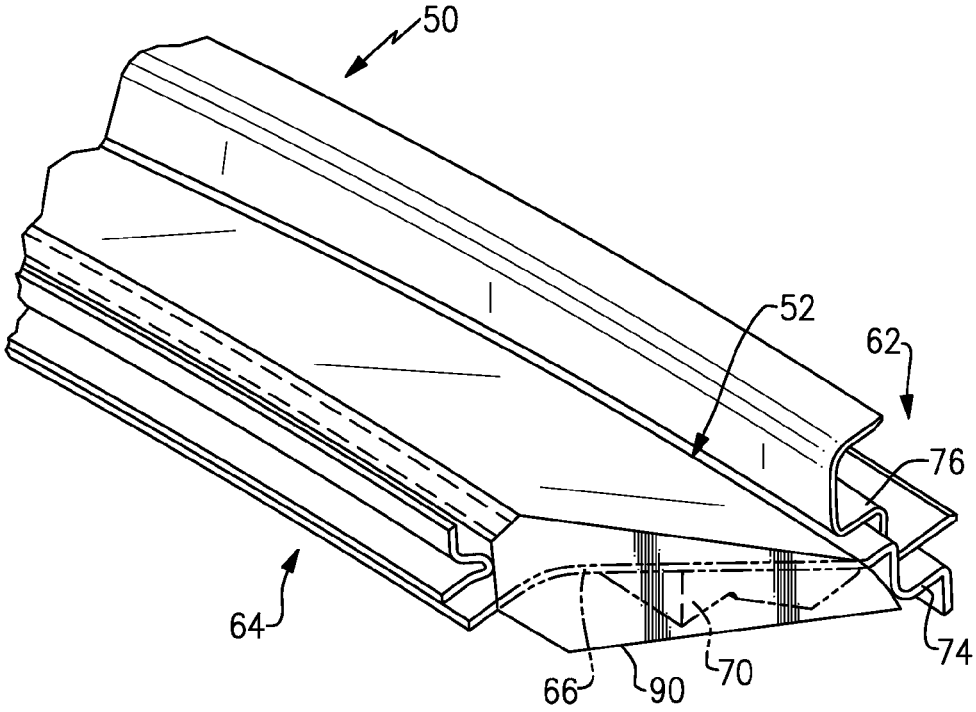
FIG. 3 illustrates another BOAS that can be incorporated into a gas turbine engine.

In one non-limiting embodiment, the shiplap structure 90 at least partially overlaps at least a portion of the leading edge portion 62 of the seal body 52 (See FIG. 2). In another non-limiting embodiment, the shiplap structure 90 at least partially overlaps a portion of the trailing edge portion 64 of the seal body 52 (See FIG. 3). In yet another non-limiting embodiment, the shiplap structure 90 overlaps portions of both the leading edge portion 62 and the trailing edge portion 64 of the seal body 52 (See FIG. 4, described in greater detail below).

Figure 4:
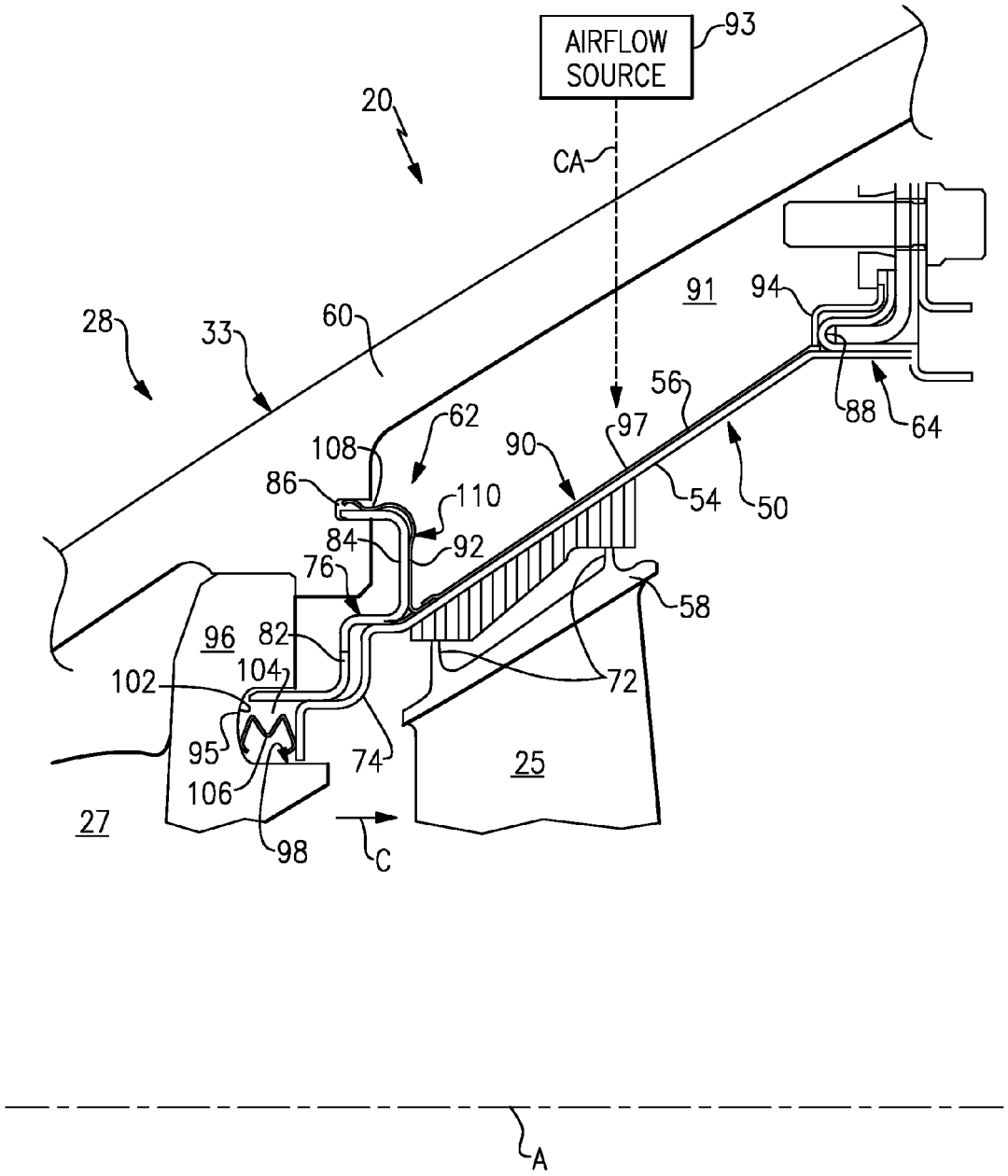
FIG. 4 illustrates a cross-sectional view of a portion of a gas turbine engine that can incorporate a BOAS.

FIG. 4 illustrates a cross-sectional view of a BOAS 50 mounted within the gas turbine engine 20. The BOAS 50 is mounted radially inward from a casing 60 of the engine static structure 33. The casing 60 may be an outer engine casing of the gas turbine engine 20. In this exemplary embodiment, the BOAS 50 is mounted within the turbine section 28 of the gas turbine engine 20. However, it should be understood that other portions of the gas turbine engine 20 could benefit from the teachings of this disclosure, including but not limited to, the compressor section 24.

In this exemplary embodiment, a blade 25 (only one shown, although multiple blades could be circumferentially disposed about a rotor disk (not shown) within the gas turbine engine 20) is mounted for rotation relative to the casing 60 of the engine static structure 33. In the turbine section 28, the blade 25 rotates to extract energy from the hot combustion gases that are communicated through the gas turbine engine 20 along the core flow path C. A vane 27 is also supported within the casing 60 adjacent to the blade 25. The vane 27 (additional vanes could circumferentially disposed about the engine longitudinal centerline axis A as part of a vane assembly) prepares the core airflow for the blade(s) 25. Additional rows of vanes could also be disposed downstream from the blade 25, although not shown in this embodiment.

The blade 25 includes a blade tip 58 at a radially outermost portion of the blade 25. In this exemplary embodiment, the blade tip 58 includes at least one knife edge 72 that extends toward the BOAS 50. The BOAS 50 establishes an outer radial flow path boundary of the core flow path C. The knife edge(s) 72 and the BOAS 50 cooperate to limit airflow leakage around the blade tip 58. The radially inner face 54 of the BOAS faces toward the blade tip 58 of the blade 25 (i.e., the radially inner face 54 is positioned on the core flow path C side) and the radially outer face 56 faces the casing 60 (i.e., the radially outer face 56 is positioned on a non-core flow path side).

The BOAS 50 is disposed in an annulus radially between the casing 60 and the blade tip 58. Although this particular embodiment is illustrated in cross-section, the BOAS 50 may be attached at its mate face 66 (and at its opposite mate face) to additional BOAS segments to circumscribe associated blades 25 of the compressor section 24 and/or the turbine section 28. A cavity 91 radially extends between the casing 60 and the radially outer face 56 of the BOAS 50. The cavity 91 can receive a dedicated cooling airflow CA from an airflow source 93, such as bleed airflow from the compressor section 24, which can be used to cool the BOAS 50.

The radially outer portion 84 of the retention flange 76 is received within a slot 86 of the casing 60 to radially retain the BOAS 50 to the casing 60 at the leading edge portion 62. The radially inner portion 82 of the retention flange 76 can be received within a groove 95 of a vane segment 96 of the vane 27 to radially support the vane 27. In this exemplary embodiment, the vane segment 96 is a vane platform and the groove 95 is positioned on the aft, radially outer diameter side of the vane 27. The vane segment 96 rests against the radially inner portion 82.

The seal land 74 radially supports the retention flange 76. In other words, the retention flange 76 contacts the seal land 74 such that the vane 27 is prevented from creeping inboard a distance that would otherwise permit the vane segment 96 from being liberated from the casing 60.

The seal land 74 extends radially inwardly from the radially inner face 54 of the BOAS 50 and contacts a portion 98 of the vane segment 96 such that a pocket 100 extends between an aft wall 102 of the vane segment 96 and an upstream wall 104 of the seal land 74. A seal 106 can be received within the pocket 100 between the aft wall 102 and the upstream wall 104.

In this exemplary embodiment, the seal 106 is a W-seal. However, other seals are also contemplated as within the scope of this disclosure, including but not limited to, sheet metal seals, C-seals, and wire rope seals. The seal 106 prevents airflow from leaking out of the cavity 91 into the core flow path C (and vice versa). The seal land 74 also acts as a heat shield by blocking hot combustion gases that may otherwise escape the core flow path C and radiate into the vane segment 96 or other portions of the vane 27.

In this embodiment, the BOAS 50 includes a shiplap structure 90 having a first shiplap portion 92, a second shiplap portion 94 and a body portion 97. The first shiplap portion 92 and the second shiplap portion 94 extend in the radial direction (i.e., toward the casing 60) from the body portion 97 of the shiplap structure 90, which can be attached to the radially outer face 56 of the seal body 52. In this embodiment, the first shiplap portion 92 overlaps the leading edge portion 62 of the seal body 52. For example, the first shiplap portion 92 can radially extend along at least a portion of the radially outer portion 84 of the retention flange 76. A seal 108, such as a leaf seal, can be attached to a radially outer portion 110 of the first shiplap portion 92. The seal 108 extends into the slot 86 of the casing 60.

The second shiplap portion 94 overlaps the trailing edge portion 64 of the seal body 52. In this embodiment, the second shiplap portion 94 overlaps at least a portion of the engagement feature 88 of the trailing edge portion 64. The shiplap structure 90, including the first shiplap portion 92, the second shiplap portion 94 and the body portion 97, retains air pressure within the cavity 91 by sealing potential leakage areas of the BOAS 50.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would recognize that various modifications could come within the scope of this disclosure. For these reasons, the following claims should be studied to determine the true scope and content of this disclosure.

What is claimed is:

1. A blade outer air seal (BOAS) for a gas turbine engine, comprising:

a seal body having a radially inner face and a radially outer face that axially extend between a leading edge portion and a trailing edge portion;

a retention flange that extends from said seal body at said leading edge portion, wherein said retention flange includes a radially outer portion and a radially inner portion, and said radially outer portion is received within a slot of a casing of the gas turbine engine and a vane segment rests against said radially inner portion;

a shiplap structure that at least partially overlaps at least a portion of at least one of said leading edge portion and said trailing edge portion; and a seal land that extends from said seal body and radially supports said retention flange at two different radial locations of said retention flange.

2. The BOAS as recited in claim 1, wherein said shiplap structure includes a first shiplap portion that overlaps said leading edge portion of said seal body.

3. The BOAS as recited in claim 2, wherein said shiplap structure includes a second shiplap portion that overlaps said trailing edge portion of said seal body.

4. The BOAS as recited in claim 2, wherein said first shiplap portion radially extends from a body portion of said shiplap structure that is attached to said radially outer face of said seal body.

5. The BOAS as recited in claim 2, wherein a seal is attached to a radially outer portion of said first shiplap portion.

6. The BOAS as recited in claim 1, wherein said shiplap structure overlaps said leading edge portion, said trailing edge portion and said radially outer face of said seal body.

7. The BOAS as recited in claim 1, wherein said shiplap structure overlaps said radially outer portion of said retention flange that extends from said leading edge portion of said seal body.

8. The BOAS as recited in claim 1, wherein a portion of said shiplap structure is circumferentially offset from a mate face of said seal body.

9. A gas turbine engine, comprising:

a compressor section;

a combustor section in fluid communication with said compressor section;

a turbine section in fluid communication with said combustor section;

a blade outer air seal (BOAS) associated with at least one of said compressor section and said turbine section, wherein said BOAS includes:

a seal body having a radially inner face and a radially outer face that axially extend between a leading edge portion and a trailing edge portion;

a retention flange that extends from said leading edge portion and including a radially outer portion received within a slot of a casing of the gas turbine engine and a radially inner portion received against a vane segment of the at least one of said compressor section and said turbine section, wherein a seal land of said seal body radially supports said retention flange at two different radial locations of said retention flange;

a second retention flange that extends from said trailing edge portion; and a shiplap structure including a first shiplap portion in contact with said retention flange, a second shiplap portion in contact with said second retention flange, and a body portion in contact with said radially outer face of said seal body along an entire length from said first shiplap portion to said second shiplap portion.

10. The gas turbine engine as recited in claim 9, wherein said retention flange includes a radially outer portion and a radially inner portion, and said radially outer portion is received within a slot of a casing and a vane segment of one of said compressor section and said turbine section rests against said radially inner portion.

11. The gas turbine engine as recited in claim 9, wherein said first shiplap portion includes both a radially extending portion and an axially extending portion that contact said retention flange.

12. A method of sealing portions of a blade outer air seal (BOAS) of a gas turbine engine, comprising:

overlapping a seal body of the BOAS with a shiplap structure, the shiplap structure including at least a first shiplap portion in contact with a retention flange of a leading edge portion of the seal body, a body portion in contact with a radially outer face of the seal body across a length that extends from the leading edge portion to a trailing edge portion, and a second shiplap portion in contact with an engagement flange or hook of the trailing edge portion;

wherein the retention flange includes a radially outer portion received within a slot of a casing of the gas turbine engine and a radially inner portion received against a vane segment; and wherein a seal land of the seal body radially supports the retention flange at two different radial locations of the retention flange.

13. A gas turbine engine, comprising:

a casing;

a blade mounted for rotation relative to said casing;

a vane mounted adjacent to said blade;

a blade outer air seal (BOAS) positioned radially outward of a blade tip, said BOAS including:

a seal body;

a retention flange extending from said seal body and including a radially outer portion received within a slot of said casing and a radially inner portion received within a groove of a vane segment of said vane;

a shiplap structure overlapping said retention flange and including a seal that extends into said slot of said casing; and said seal body includes a seal land in contact with both said radially outer portion and said radially inner portion of said retention flange.

14. The gas turbine engine as recited in claim 13, wherein said seal land radially supports said retention flange at both said radially outer portion and said radially inner portion.

15. The gas turbine engine as recited in claim 14, wherein said seal land contacts said vane segment.

16. The gas turbine engine as recited in claim 15, comprising a seal received within a pocket established between an aft wall of said vane segment and an upstream wall of said seal land.

17. The gas turbine engine as recited in claim 16, wherein said seal is a W-seal.

18. The gas turbine engine as recited in claim 13, wherein said radially outer portion of said retention flange is C-shaped and said radially inner portion of said retention flange is L-shaped.

* * * * *